US006112617A

United States Patent [19]

Abrams et al.

[11] Patent Number: 6,112,617

[45] Date of Patent: Sep. 5, 2000

[54] COMPOSITE WINCH HANDLES

[76] Inventors: David Bartlett Abrams, 12127 Nikita Ct., San Diego, Calif. 92131; Kenneth Charles Gamble, 2356 Mount Baker Hwy., Bellingham, Wash. 98225

[21] Appl. No.: 08/883,385

[22] Filed: Jun. 26, 1997

[51] Int. Cl.[7] ..... G05G 1/10

[52] U.S. Cl. ..... 74/545; 74/543

[58] Field of Search ..... 74/545, 543, 544, 74/546, 547; 16/115; 242/283, 284

[56] References Cited

U.S. PATENT DOCUMENTS

| | | | |
|---|---|---|---|
| D. 275,138 | 8/1984 | Bacon | D34/33 |
| D. 355,519 | 2/1995 | Crawford | D34/35 |
| 3,406,590 | 10/1968 | Popeil | 74/545 |
| 4,338,827 | 7/1982 | Hooker | 74/545 |
| 4,531,715 | 7/1985 | Wiens | 254/266 |
| 4,582,298 | 4/1986 | Boome et al. | 254/266 |
| 4,883,255 | 11/1989 | Bacon | 254/266 |
| 5,255,573 | 10/1993 | Estabrook | 74/545 |
| 5,394,769 | 3/1995 | Cropley | 74/545 |
| 5,509,327 | 4/1996 | Cropley | 74/545 |

FOREIGN PATENT DOCUMENTS

| | | | |
|---|---|---|---|
| 2664718 | 1/1992 | France | 74/545 |
| 2216823 | 10/1973 | Germany | 74/545 |

*Primary Examiner*—Mary Ann Battista
*Attorney, Agent, or Firm*—Mark H. Snyder

[57] ABSTRACT

Winch handles for use in manually operating winches, such as those found on marine vessels. The handles include a grip member, a body member and a lug member. The body member is comprised of continuous fiber reinforced composite material. The handles are lightweight, corrosion resistant, and capable of floating in water if dropped overboard of a marine vessel.

7 Claims, 3 Drawing Sheets

COMPOSITE WINCH HANDLES

FIELD OF THE INVENTION

The present invention relates to winch handles for use in manually operating winches on marine vessels.

BACKGROUND OF THE INVENTION

Winch handles are commonly used on marine vessels, such as sailboats, for the manual operation of winches. A winch generally consists of a drum having concave sides, around which a line can be wound. When handling lines under a significant amount of tension, such as sheets or halyards on sailing vessels, winches give the user a mechanical advantage in overcoming such tension. Winches can also be used for a number of other applications, such as for handling anchor rodes when raising or lowering an anchor.

In general, a winch handle is a lever arm that is coupled to the winch, which allows the user of the winch to exert a rotational force on the winch. In this manner, the winch user can pull-in or let-out a line under significant tension. Handles of this type are shown or described in U.S. Pat. No. 5,509,327 by Cropley, issued Apr. 23, 1996, entitled "WINCH HANDLE"; U.S. Pat. No. 5,394,769 by Cropley, issued Mar. 7, 1995, entitled "HANDLE"; U.S. Pat. No. D355,519 by Crawford, issued Feb. 14, 1995, entitled "WINCH HANDLE"; U.S. Pat. No. 5,255,573 by Estabrook, issued Oct. 26, 1993, entitled "WINCH HANDLE"; U.S. Pat. No. 4,883,255 by Bacon, issued Nov. 28, 1989, entitled "WINCH HANDLE"; U.S. Pat. No. D275,138 by Bacon, issued Aug. 14, 1984, entitled "HANDLE FOR WINCH OR WINDLASS"; and U.S. Pat. No. 4,338,827 by Hooker, issued Jul. 13, 1982, entitled "FLOATING MARINE WINCH HANDLE".

One disadvantage of many of such known winch handles is their excessive weight. In order to obtain the required strength for the winch handle to withstand the stresses placed upon it in service, such handles are often constructed of heavy metal. Although excessive weight may not be a problem on motorized vessels, sailors of sailing vessels, particularly those involved in the sport of competitive sailing, are obsessed with the reduction of weight on the vessel, which can create a speed advantage in sailing races. In addition, the weight of the winch handle can cause it to sink rapidly and irretrievably when accidentally dropped overboard. The loss of a winch handle can therefore create a substantial inconvenience and expense to the owner.

Another disadvantage of many of such known winch handles is that they are susceptible of corrosion in marine environments, such as the ocean.

U.S. Pat. No. 4,338,827 by Hooker, addresses many of the described disadvantages. Hooker is directed to a plastic three piece winch handle having thin walled plastic tubes with solid plastic plugs bonded into the tubes to create sealed air spaces that impart buoyancy to the winch handle when accidentally dropped overboard.

Although Hooker addresses the loss of winch handles when they are dropped overboard, the plastic winch handle to which the '827 Patent is directed has been criticized for a lack of strength and rigidity. In addition, each buoyant portion of the winch handle described in Hooker consist of at least three pieces that are bonded together. If any of these bonds or bonded pieces leak, the handle will no longer float.

U.S. Pat. No. 5,509,327 by Cropley addresses deficiencies in the strength, rigidity, and "cumbersome" operability of the winch handle described in U.S. Pat. No. 4,338,827 by Hooker. The '327 Patent by Cropley is directed to a buoyant winch handle having a two piece body that contains transverse and angled reinforcing webs to impart strength and rigidity to the winch handle.

U.S. Pat. No. 5,394,769 by Cropley is also directed to a winch handle having a two piece body that contains transverse and angled reinforcing webs to impart strength and rigidity to the winch handle.

The winch handles to which U.S. Pat. Nos. 5,509,327 and 5,394,769 by Cropley are directed, have several undesirable attributes. The complexity of the reinforced body members make these parts difficult to manufacture. In addition, during fabrication, the two piece body members must undergo the additional step during manufacturing to seal them together to form a unitary winch handle body. These seals are always susceptible to breakage, if, for example, the winch handle is dropped on a hard surface, such as the deck of a marine vessel. Breakage of these seals can adversely affect the strength of the winch handle. Further, the transverse and angled reinforcing webs undesirably increase the weight of the winch handle.

In light of the above discussion regarding known winch handles, it is apparent that there is a need to provide a winch handle that addresses the problems associated with the use of such handles. In particular, it is desirable to provide a lightweight winch handle which has the requisite strength and rigidity. It is also desirable to provide a winch handle that is resistant to corrosion in marine environments. Further, it is desirable to provide a winch handle that is capable of floating in water. Yet further, it is desirable to provide a winch handle that is simple to manufacture.

SUMMARY OF THE INVENTION

One object of the present invention is to provide lightweight, strong and rigid winch handles.

Another object of the present invention is to provide winch handles that are resistant to corrosion in marine environments.

Another object of the present invention is to provide winch handles which float in water.

A further object of the present invention is to provide winch handles that are simple to manufacture.

Yet further objects and advantages of the present invention will become apparent as the present invention is herein further described.

In accordance with the present invention, composite winch handles are provided for the manual operation of winches and the like. In general, the winch handles include a grip member, a lug member, and a body member.

The body member is an elongate structure comprised of a composite material. The body member can contain an internal cavity, which allows the winch handle to float when placed in water. The grip member is connected to one end of the body member and includes a hand grip for manipulation of the winch handle by the user. The lug member is connected to another end of the body member and is designed to be inserted into the socket of a winch.

In accordance with the present invention, a composite winch handle is also provided which includes a seamless body member. A seamless body member contains no sealed or bonded seams or plugs, which would increase the susceptibility of the body member to leakage and loss of strength and rigidity due to failure of such bonds or seals.

In accordance with the present invention, the winch handle body members described herein can be comprised of a composite material that includes a continuous fiber reinforcement.

In accordance with the present invention, light weight winch handles are provided which weigh less than known winch handles.

In accordance with the present invention, methods for manufacturing composite winch handles are provided. Such methods include the steps of providing a matrix material, a fibrous reinforcement, and a winch handle body member mold tool, forming a preform using the fibrous reinforcement and the winch handle body member mold tool, and redistributing the matrix material around the fibrous reinforcement to form a winch handle body member. In addition, the grip member and/or lug member can be integrally molded into the body member.

DETAILED DESCRIPTION

Figure 1:
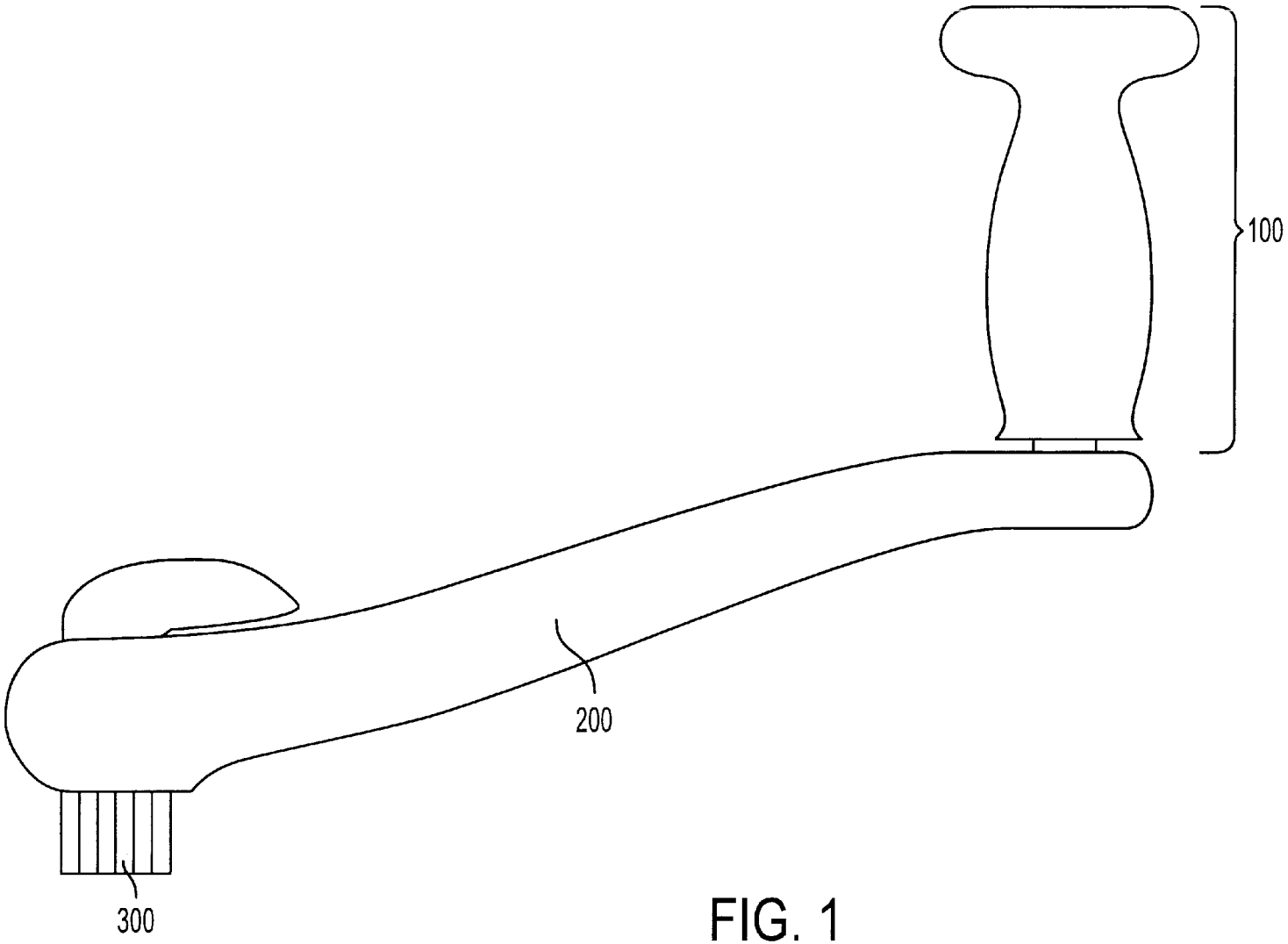
FIG. 1 is a perspective view of one embodiment of the winch handles of the present invention.

As described more fully below, the present invention is directed toward composite winch handles for use in the manual operation of winches commonly found on marine vessels. In particular, the composite winch handles of the present invention comprise a body member, a grip member and a lug member.

The body members of the composite winch handles of the present invention are generally elongate in shape, and have two ends; a lug end and a grip end. As used herein, the term "elongate" refers to any structure having a longitudinal cross-sectional dimension greater than its transverse cross-sectional dimension. Preferably, the body member structure is also tubular. As used herein, the term "tubular" refers to a structure that contains walls that define an internal cavity. It is to be understood that no specific transverse or longitudinal cross-sectional geometry of the structure is intended be implied by the use herein of the terms "elongate" or "tubular".

In one embodiment of the present invention, the body member is seamless. In a preferred embodiment, the structure of the body member defines a single internal cavity. As used herein, the term "seamless" refers to structures that contain no bonded or sealed seams or plugs. It is a highly desirable feature of the preferred embodiment of the present invention that the body member be seamless. The lack of bonded or sealed portions of the body member reduces the susceptibility of the body member to leakage and loss of strength due to failure of such bonds or seals.

In another embodiment of the present invention, the body member is seamless, and the body member structure defines a plurality of internal cavities. In such embodiment, the external walls of the body member can be reinforced with one or more internal reinforcing structures which, along with the external walls, define a plurality of internal cavities. Although internal reinforcing structures may be used, it should be noted that no internal reinforcing structures are required due to the excellent strength and stiffness afforded by the composite materials described herein for use in the fabrication of the body member.

The body member can be constructed of nearly any composite material. Composite materials are particularly useful because they typically have higher strength to weight ratios than isotropic materials, such as metals, and plastic. Such composite materials include, but are not limited to, polymer matrix composites, metal matrix composites, and ceramic matrix composites.

Particularly suitable for use in the present invention are polymer matrix composites. Polymer matrix composites are generally more corrosion resistant than metal, particularly in marine environments such as the ocean. Suitable polymer matrices include thermoset and thermoplastic polymers. Suitable thermoset polymer matrices include, but are not limited to, epoxy resins, phenolic resins, polyester resins, bismaleimide resins, cyanate ester resins and combinations thereof. Suitable thermoplastic polymer matrices include, but are not limited to polyetheretherketone (PEEK), nylon, polyimides, polyamide-imides, polyether-imides, polysulfones, and combinations thereof. In order for the winch handle to survive over a period of many months in harsh marine environments, and rough handling, such as being dropped on the deck of a marine vessel, it is also desirable that the polymer matrices be toughened improve their impact resistance.

Polymer matrices that are preferred for use are those with good strength, weather resistance, abrasion resistance, toughness and low moisture pick-up. Particularly suitable for use as a polymer matrix in the present invention are epoxy resins.

Within such matrices, numerous types of reinforcing materials can be used. Suitable reinforcements include those which have high values of specific strength and stiffness. For polymer matrix composites, reinforcements which are suitable include, but are not limited to, boron fibers, glass fibers, quartz fibers, carbon fibers, aramid fibers and polyethylene fibers. Particularly suitable as a reinforcement are carbon fibers, due to their high values of specific strength and stiffness. The reinforcements can be in unidirectional or multi-directional forms. Woven reinforcements are very desirable as a reinforcement when the material must conform to complex shapes.

In one embodiment of the present invention, the fibrous reinforcement is a continuous fiber reinforcement. As used herein, the phrase "continuous fiber reinforcement" refers to reinforcements wherein the average individual fiber length is greater than about 1 inch (2.54 centimeters) in length. The use of continuous fiber reinforcements are particularly desirable in the winch handles of the present invention, because the direction of the fibers in the matrix material can be controlled. It has been found by the inventors that by controlling the direction of the fibers, the physical properties, such as strength and rigidity of the body member, can be altered to a much greater extent than when noncontinuous fiber reinforcements or isotropic materials are used. Accordingly, a composite body member which utilizes a continuous fiber reinforcement can be designed that has sufficient strength and rigidity to be useful in a winch handle, yet does not incorporate internal reinforcing elements.

The body member of the winch handle can contain at least one internal cavity, which can provide buoyancy to the winch handles of the present invention. As used herein, the terms "buoyant" and "buoyancy" refer to the capability of the object to which they relate to be able to float in water. In one embodiment of the present invention, the internal cavity of the body member contains a buoyant material to enhance the buoyancy of the winch handle. The use of a buoyant material in the body member is very desirable because it can maintain the buoyancy of the winch handle if the walls of the body member have been penetrated by water or another material.

Buoyant materials suitable for use in the present invention include, but are not limited to, thermoset and thermoplastic polymeric foam materials. Desirable thermoset polymeric foam materials include, but are not limited to, polyurethane foam materials.

The body members described herein can be described as having a longitudinal axis that can be a straight line from one end of the tube member to the other, or a longitudinal axis that is angled and/or curved at one or more locations from one end of the body member to the other. In some instances it can be desirable to angle and/or curve the longitudinal axis of the tube member to make it easier to manipulate the winch handle when in use. For example, it is generally desirable to angle the body member upwards, and away from the top of the winch to prevent contact of the user's body parts with the winch handle as it is swung through an arc during use. In a preferred embodiment of the present invention, the longitudinal axis of the body member is angled in one or more locations to enhance the ease in which the winch handle can be manipulated by the user when it is engaged with a winch.

The composite winch handles of the present invention also include a grip member, which allows manipulation of the winch handle by a user when it is engaged with a winch. The grip member is attached to the body member, and preferably is capable of rotating relative to the body member. In one embodiment of the present invention, the grip member includes a hand grip and a pin. In use, the hand grip is held in the user's hand, and is fixed to the body member using the pin or similar device. The pin can be made of many strong materials. If it is desirable for the winch handle to be buoyant, is desirable that the material from which the pin is manufactured also be lightweight, so as not to substantially detrimentally affect such buoyancy. Suitable materials include metals and composite materials.

The pin can extend partially into or entirely through the body member. In one embodiment of the present invention, the pin can be integrally molded into the body member, and the grip member is rotatably affixed to the pin. In another embodiment of the present invention, the grip member is integrally molded with or bonded to the pin, and the pin is rotatably affixed to the body member. In yet another embodiment of the present invention, the grip member is rotatably affixed to the pin and the pin is rotatably affixed to the body member. To facilitate such rotation, moving bearings, such as ball bearings, or low friction bearing surfaces, such as polytetraflouroethylene (PTFE) can be placed between the moving surfaces.

The hand grip can be comprised of any durable material suitable for use as a handle material. Such materials include, but are not limited to wood, composite materials, rubber, and other elastomeric materials. Particularly suitable for use as materials for the hand grip include those materials which are also buoyant. Also, it is desirable that the hand grip be ergonomically molded to reduce hand fatigue and increase gripping strength on the grip member by the user. In addition, the hand grip can contain a lip or other feature for preventing the user's hand(s) from slipping off the grip member.

The grip member can be designed to accommodate the use of one or two hands. The use of a two-handed grip member allows the user to obtain approximately forty percent more force for rotating the winch. One example of a two-handed grip member suitable for use with the body member of the present invention is described in U.S. Pat. No. 5,225,573 by Estabrook, entitled "WINCH HANDLE".

The composite winch handles of the present invention also include a lug member which provides a connection from the winch handle to the winch. The lug member is typically a four or eight pointed star in shape. The lug member should be comprised of a strong, abrasion resistant material which can withstand the torque applied to it through the winch handle. Typically, lug members are made of metal, such as aluminum or steel.

The lug member can contain a locking feature to prevent the winch handle from falling out of the winch socket during use. Locking lug members typically contain a thumb switch which allows the user to engage and disengage the locking device when inserting and removing the lug member from a winch. Several such devices are known in the art. One such device is described in U.S. Pat. No. 4,885,255 by Bacon, entitled "WINCH HANDLE". The lug member can be either bonded into the body member or integrally molded into the body member. It is most desirable, however, that the lug member be integrally molded into the body member.

The present invention will now be described in more detail with respect to the drawings. As shown in the perspective view in FIG. 1, one embodiment of winch handles of the present invention includes a grip member 100, a body member 200, and a lug member 300. When in use, lug member 300 is inserted into the socket of the winch, and grip member 100 is grasped by the user's hand. The user can then exert a force on the grip member 100 which exerts a torque on the winch.

Figure 2:
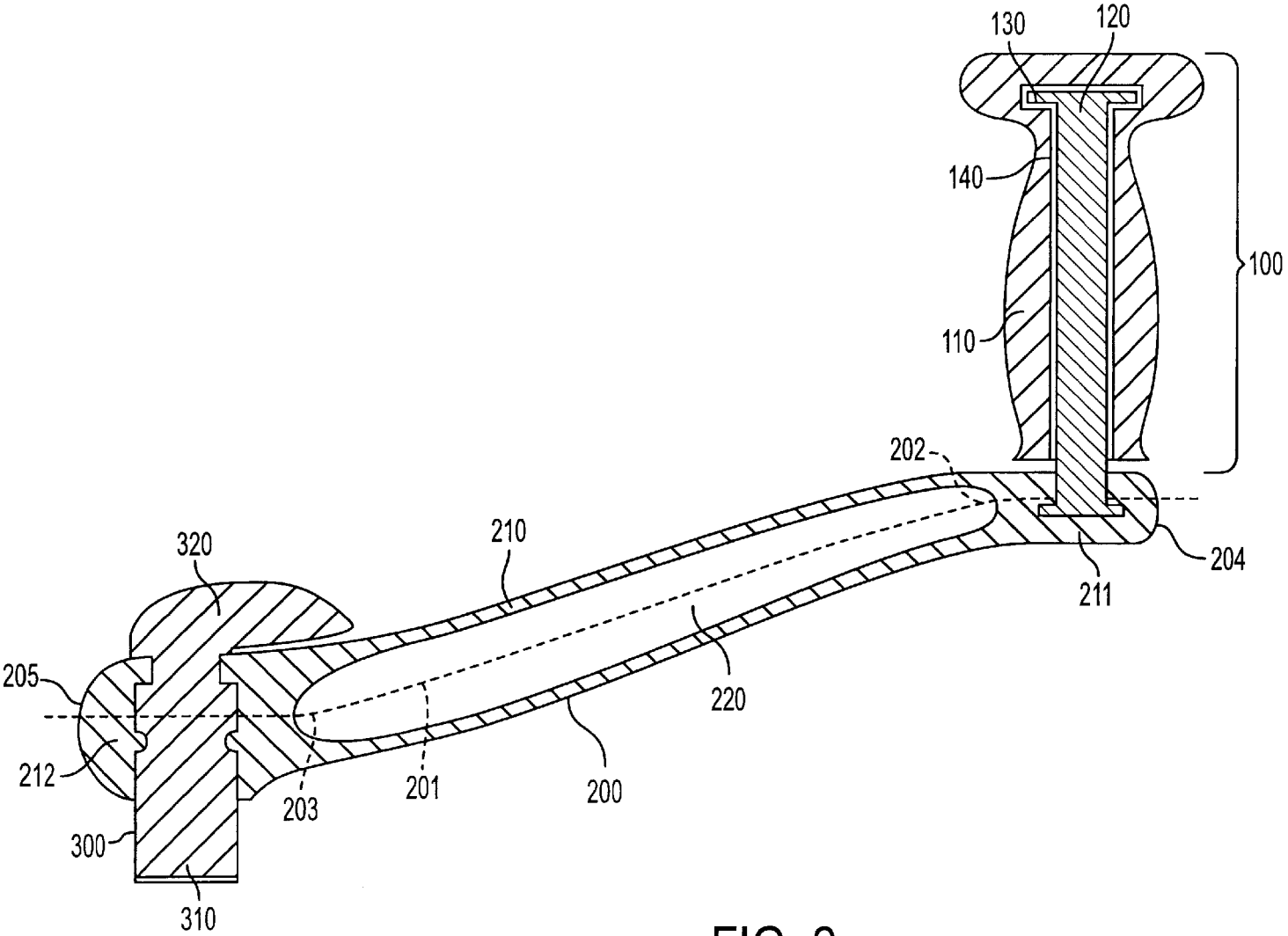
FIG. 2 is a longitudinal cross sectional view of one embodiment of the winch handles of the present invention.

As shown in the longitudinal cross-sectional view in FIG. 2, the grip member 100, comprises a hand grip 110, and a grip pin 120. Although the grip pin can be bonded or integrally molded into the hand grip 110 or the body member 200, it is shown in FIG. 2 as integrally molded with one end of the body member 200. Preferably, the grip member can rotate relative to the body member. As shown in FIG. 2, clearance 140 between the substantially parallel sides of the grip pin 120 and the hand grip 110 allows the hand grip 110 to rotate freely from the grip pin 120. The lip 130 on grip pin 120, prevents the hand grip 110 from sliding off the grip pin 120. To enhance the free rotation, and decrease the wear on the hand grip 110 or grip pin 120, a bearing or bearing surface (not shown) can be inserted in the clearance 140 between the substantially parallel sides of the grip pin 120 and the hand grip 110.

As further shown in the longitudinal cross-sectional view in FIG. 2, body member 200 has a longitudinal axis 201, which is angled at two spots 202, 203 from one end (the grip end) 204, to the other end (the lug end) 205 of the body member 200. The distance between the two ends 204, 205 of the body member 200 along longitudinal axis 201, defines a longitudinal cross-sectional dimension of the winch handle.

Seamless body member 200 comprises a tubular wall 210 of a composite material and two integrally molded composite end portions 211, 212, that define an internal cavity 220. Typically, internal cavity 220 contains a buoyant foam material.

With continued reference to the longitudinal cross-sectional view in FIG. 2, the winch handle includes a lug member 300, which comprises a toothed lug 310 and a locking mechanism thumb switch 320. As shown, lug member 300 is preferably integrally molded with the body member 200.

Figure 3:
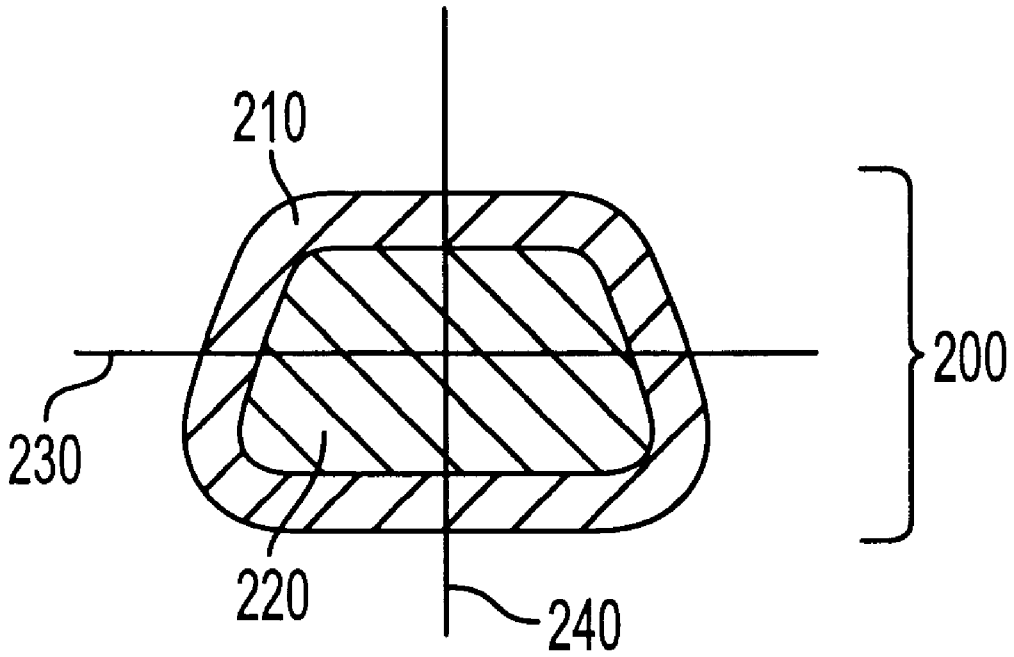
FIG. 3 is a transverse cross sectional view of one embodiment of the winch handles of the present invention.

As shown in the transverse cross-sectional view in FIG. 3, the composite tubular wall 210 contains no seams, and defines an internal cavity 220. The body member 200 has one or more transverse cross-sectional dimensions between opposed sides of the composite tubular wall 210 as shown along lines 230 and 240.

One very desirable feature of the present invention is the ability to obtain very light weight winch handles. The use of a composite body member, particularly a composite body member utilizing a continuous fiber reinforcement provides for a winch handle (including the grip member and lug member) which is substantially lighter than those known in the art.

The lightest commercially available winch handle of at least 8 inches in length (20.3 centimeters) known to the inventors, is a floating winch handle manufactured by Titan Australia Pty. Ltd., Sydney, Australia, that weighs more than 250 grams. The lightest commercially available winch handle of at least 10 inches in length (25.4 centimeters) known to the inventors, is a floating winch handle manufactured by Titan Australia Pty. Ltd., Sydney, Australia, that weighs more than 300 grams.

In contrast to known winch handles, in some embodiments of the winch handles of the present invention, a winch handle of at least about 8 inches (20.3 centimeters) in length weighs less than about 240 grams. In a preferred embodiment of the winch handles of the present invention, a winch handle of at least about 8 inches (20.3 centimeters) in length weighs less than about 220 grams. In a more preferred embodiment of the winch handles of the present invention, a winch handle of at least about 8 inches (20.3 centimeters) in length weighs less than about 200 grams.

In some embodiments of the winch handles of the present invention, a winch handle of at least about 10 inches (25.4 centimeters) in length weighs less than about 290 grams. In a preferred embodiment of the winch handles of the present invention, a winch handle of at least about 10 inches (25.4 centimeters) in length weighs less than about 270 grams. In a more preferred embodiment of the winch handles of the present invention, a winch handle of at least about 10 inches (25.4 centimeters) in length weighs less than about 250 grams.

The present invention also includes methods for manufacturing the composite winch handles of the present invention. Although many composite materials can be used in the practice of the present invention, for simplicity, the use of fiber reinforced polymer matrix composites will be discussed in relation to the methods of the present invention.

One desirable attribute of the composite winch handles of the present invention is the simplicity of the methods for manufacturing them. The composite winch handles of the present invention can be manufactured using a number of composite materials fabrication techniques which utilize an external (female) and/or an internal (male) mold structure. Such fabrication techniques include, but are not limited to, resin transfer molding, compression molding, bladder molding, vacuum bag molding, autoclave molding, filament winding, and tube wrapping. In each of these processes, a female and or male mold tool is used to form the composite material into the desired body member shape.

The composite material, which may be a fibrous material pre-impregnated with resin (prepreg), or unimpregnated fiber, such as a fibrous cloth, can be formed into a preform. In one embodiment of the present invention, a preform can be formed by wrapping the composite material around a male mold tool, such as a metal mandrel, as in tube wrapping and filament winding. In another embodiment of the present invention, a preform can be formed by laying-up or inserting composite material into the cavity of a female mold tool, as in compression molding. In a preferred embodiment, the preform is formed around a male mold tool, such as a mandrel, bladder or lightweight buoyant material, and then inserted into the cavity of a female mold tool. In this manner, the male mold tool assists in supporting the composite material during subsequent molding. If desired, parts of the grip member and/or lug member can also be incorporated into the preform for integrally molding these parts into the body member.

A polymeric matrix can then be combined with the fiber reinforcement in the preform, or may already be present if a prepreg material has been used. To form a solid body member, the polymeric matrix must be redistributed. As used herein, the term "redistributed" refers to the movement of the matrix material relative to the reinforcing material, which can result in consolidation of the composite material. Polymeric matrix redistribution can be accomplished in a number of ways. For many thermoset and thermoplastic matrix materials, the temperature of the matrix can be increased above its glass transition temperature, resulting in flow of the resin. Also, pressure can be applied to the polymeric matrix to obtain flow of the polymeric matrix.

In a preferred embodiment of the present invention, the polymeric matrix is redistributed in the preform using a compression molding technique. In such technique, pressure can be applied to the composite material by applying pressure externally to the mold tool with a press and/or directly to the composite material through the use of an inflatable bladder or expandable or compressed foam material.

When thermosetting polymeric matrices are used in the practice of the present invention, the polymeric matrix is typically cured to a solid during redistribution of the matrix material. Curing of the polymeric matrix can be accomplished in a number of ways. In one embodiment of the present invention, the polymeric matrix is brought to a temperature above the ambient temperature to accelerate the cure cycle. In another embodiment, the polymeric matrix is allowed to cure at room temperature. Preferably, during the cure cycle, pressure is applied as previously described to the composite material to reduce the amount of voids in the resulting composite structure.

After the matrix material has been redistributed and/or cured, the mold can be removed from the solid body member. If the body member has been bladder molded, the bladder may be removed, or left inside the body member. If the part has been molded on a solid male mold tool, such as a metal mandrel, the mandrel must be removed if the body member is to be buoyant. Once the bladder or mandrel has been removed, the body member can be sealed by the addition of the lug end and/or grip end to the body member tube. In addition, prior to sealing the ends of the body member tube, a buoyant material can be added to the internal cavity of the body member.

In a preferred embodiment, however, the body member is compression molded with a buoyant foam core. In this manner, a seamless body member is created during molding, which contains no bonded or sealed seams or plugs. Seamless body members are less susceptible to leakage or loss of strength and rigidity, as can happen when such seals or bonds fail in a structure.

After the part has been molded, any waste material, such as flashing on the exterior can be trimmed, and the body member can be finished as desired. If the lug member and grip member were not integrally molded with the body member, then they can be bonded to the body member as desired.

The foregoing description of the invention has been presented for purposes of illustration and description. Further, the description is not intended to limit the invention to the form disclosed herein. Consequently, variations and modifications commensurate with the above teachings, and the skill or knowledge in the relevant art, are within the scope of the present invention. The embodiment described hereinabove is further intended to explain modes for practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A winch handle, comprising:

(a) an elongate, tubular body member having two enclosed ends, an internal cavity, and a longitudinal cross-sectional dimension, said body member including said two enclosed ends is seamless, and comprising a composite material;

(b) a hand grip;

(c) means for connecting said hand grip to one of said ends of said body member; and (d) a lug member connected to the other of said ends of said body member.

2. The winch handle as claimed in claim 1, wherein said composite material comprises a polymer matrix composite having a continuous fiber reinforcement.

3. The winch handle as claimed in claim 1, wherein said longitudinal cross-sectional dimension is at least about 25.4 centimeters, and said winch handle weighs less than about 290 grams.

4. The winch handle as claimed in claim 1, wherein said composite material comprises a fibrous reinforcement selected from the group consisting of glass fiber, quartz fiber, carbon fiber, aramid fiber, polyethylene fiber and boron fiber.

5. The winch handle as claimed in claim 1, wherein said winch handle floats in water.

6. A winch handle comprising a grip member, a lug member and a body member, said body member comprising a composite material with a continuous fiber reinforcement with an average fiber length greater than about 1 inch and having a single, enclosed internal cavity containing buoyant material and said body member having a longitudinal cross-sectional dimension of at least about 20.3 centimeters, and said winch handle weighs less than about 200 grams.

7. A winch handle comprising a grip member, a lug member and a body member, said body member comprising a composite material with a continuous fiber reinforcement with an average fiber length greater than about 1 inch and having a single, enclosed internal cavity containing buoyant material and said body member having a longitudinal cross-sectional dimension of at least about 25.4 centimeters, and said winch handle weighs less than about 250 grams.

* * * * *